United States Patent [19]

Grollmusz

[11] 3,995,377

[45] Dec. 7, 1976

[54] UNIVERSAL SPOT BOWLING AID

[76] Inventor: John Grollmusz, 30 Hudson Road, East Brunswick, N.J. 08816

[22] Filed: Feb. 13, 1976

[21] Appl. No.: 658,337

[52] U.S. Cl. ..... 35/29 F
[51] Int. Cl.[2] ..... G09B 9/00
[58] Field of Search ..... 35/29 F

[56] References Cited

UNITED STATES PATENTS

| | | | |
|---|---|---|---|
| 2,942,358 | 6/1960 | Pomranz | 35/29 F |
| 2,989,810 | 6/1961 | Marting | 35/29 F |
| 3,081,559 | 3/1963 | Kaminsky | 35/29 F |
| 3,279,097 | 10/1966 | Tomblin | 35/29 F |
| 3,455,032 | 7/1969 | Vail | 35/29 F |

*Primary Examiner*—Harland S. Skogquist
*Attorney, Agent, or Firm*—Arthur L. Plevy

[57] ABSTRACT

A bowling aid comprises a first and second planar member, each member having a channel extending thereacross, means for positioning said planar members one above the other with said channels positioned in congruency and facing each other to form a relatively lateral opening, a slidable member positioned in said opening and adapted to slide therein, first and second lever members pivotally secured to said slideable member and extending transverse to the same, wherein said first and second levers can pivot either integrally or independent of each other with respect to said slideable member, and one of said surfaces of said planar members including indicia at a top end thereof indicative of the formation of ten bowling pins, each of which can be accessed by the pivoting of said first lever, and a series of second indicia located above said slideable member indicative of conventional alley markers, and a series of third indicia relatively at said other end of said surface indicative of conventional starting markers used by a bowler to commence his approach to the foul line, said second lever adapted when pivoted to access any one of said third indicia, to cause said first lever when pivoted, to access a desired bowling pin location, with said second lever accessing a desired starting location, whereby when said slideable member is moved, said first and second lever members move accordingly to indicate any desired starting position in relation to any desired pin which may be a target for said bowler.

8 Claims, 4 Drawing Figures

Fig. 1.
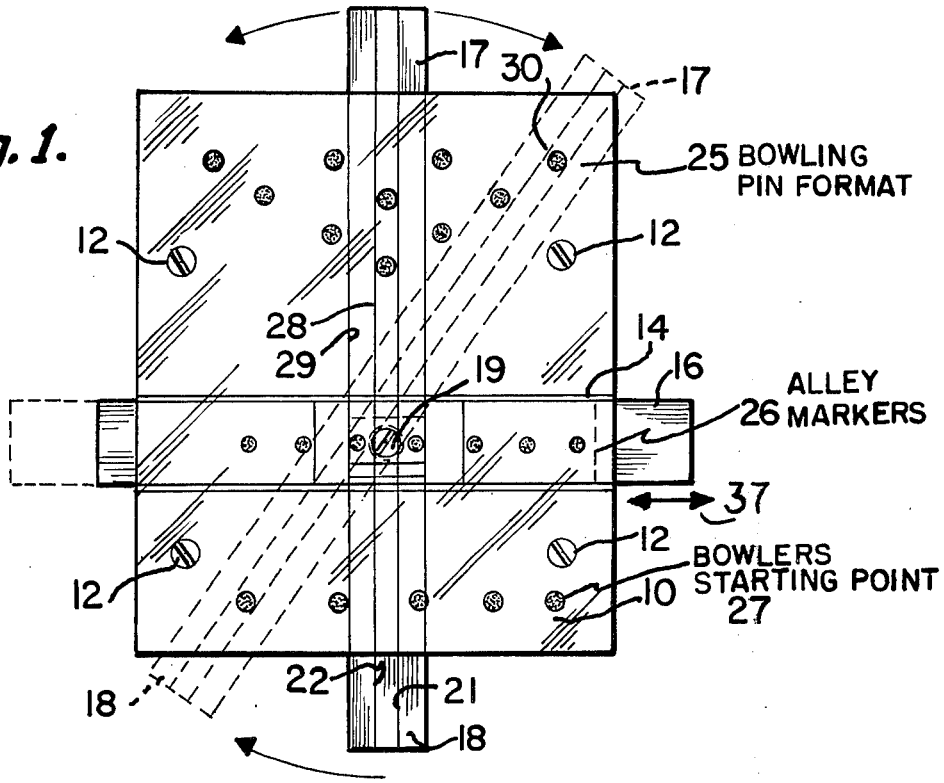
Fig. 2.
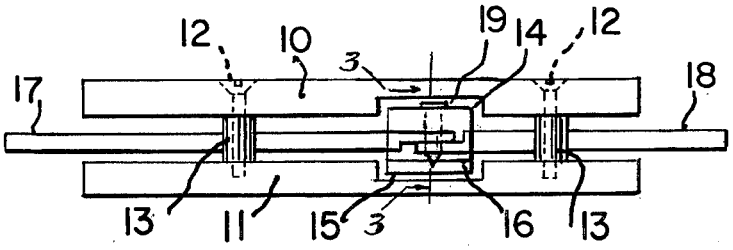
Fig. 3.
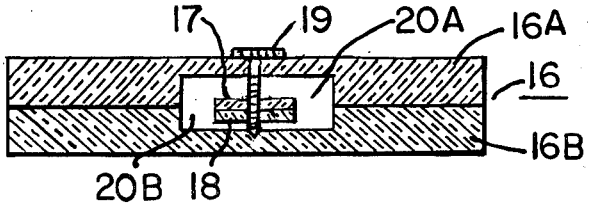
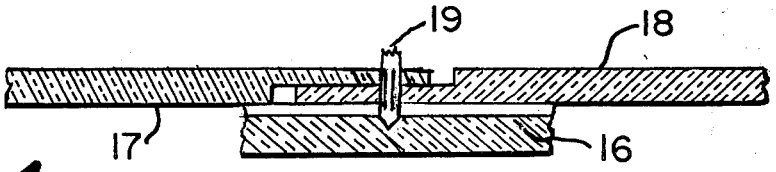
Fig. 4.

UNIVERSAL SPOT BOWLING AID

BACKGROUND OF INVENTION

This invention relates to a "spot" bowling aid which permits the bowler to preset the trajectory of his bowling ball and thereafter to manipulate the aid to inform him of where his next ball should be directed as well as his proper starting position and direction of motion for the next ball.

There exists many patents which describe apparatus to be used as aids or calculators to inform a bowler as to his aim and stance in order to improve his game and score.

Many prior art patents are relatively complicated and difficult to use and have not received wide-spread acceptance. Examples of such devices can be had by reference to U.S. Pat. No. 2,989,810 entitled BOWLING AID by R. E. Marting and issued on June 27, 1961, U.S. Pat. No. 3,081,559 entitled CALCULATOR issued on Mar. 19, 1963 to E. O. Kaminsky and U.S. Pat. No. 3,279,097 issued on Oct. 18, 1966 to J. O. Tombling, Jr. and entitled BOWLER'S SLIDE RULE.

Other patents as U.S. Pat. No. 3,455,032 and U.S. Pat. No. 3,012,339 appear to be simpler in construction but are relatively unreliable and are of questionable utility and function.

In general, all such devices are concerned with "spot" bowling, a term which is well known and widely employed in bowling parlance.

Essentially, a good bowler uses alley markers and starting markers according to the trajectory of his ball to assure that the spot or pin he is aiming for, will be proper. It is basically far simpler to aim the ball based on the alley markers, which are much closer to the foul line than to aim at the bowling pins. Based on the trajectory of the ball, if the proper alley marker is accessed by the ball, the bowler will be assured that the desired pin will be struck providing, as will be seen, that he positions himself properly before releasing his ball.

It is therefore an object of this invention to provide an improved bowling aid to enable the determination of the initial position of the bowler's stance and the alley mark over which, or in proximity to, the bowler's ball should be directed.

BRIEF DESCRIPTION OF FIGURES

FIG. 1 is a top plan view of a bowling aid according to this invention.

FIG. 2 is a side view of the aid depicted in FIG. 1.

FIG. 3 is a front view of the slide member and lever members according to this invention.

FIG. 4 is a side view particularly depicting the nature of the lever members as coupled to the slide member.

DETAILED DESCRIPTION OF FIGURES

Before proceeding with a description of the figures, it is indicated that a bowler will probably throw or place his ball so that the trajectory or path of the ball is relatively the same for each ball he throws and hence, the aid to be described will enable him to guide himself accordingly as to inform him where he is to stand and what alley marker or spot he is to aim for.

Basically, there are three main types of trajectories a bowling ball can take. These are an arcuate path from right to left, an arcuate path from left to right, or a relatively straight path. Obviously, the path that the bowler takes from the start to the foul line also determines where his ball will go as he may walk at one angle and so on. This factor will be further explained in describing the bowling aid depicted in the description of the figures to follow.

Referring to FIG. 1, there is shown a top view of an aid according to the invention. A top planar member 10 is shown generally of a rectangular configuration and preferably fabricated from a transparent material; as a polystryene, glass and so on.

Located beneath the planar member 10 is a bottom planar member 11, which is relatively congruent with member 10 and positioned beneath the same by a plurality of posts or stand off assemblies as 12. (FIG. 2). Basically as shown, the standoff assembly 12 includes a spacer 13 which determines the separation of planar members 11 and 12 and a screw or other assembly to secure the planar members 11 and 12 as shown. It is apparent that any other means for positioning one plane above the other is contemplated as well as adjoining sidewalls and so on.

Each planar member 10 and 11 has a channel 14 and 15 of a "U" shaped configuration located on a surface thereof and placed as seen in FIG. 2 facing each other in congruency when the members 10 and 11 are positioned one above the other as shown. Located within the channel thus formed, is a slideable member 16. The member 16 can move in the direction of arrow 37 as constrained by the channels 14 and 15. Pivotally secured relatively at the center of member 16 are a first lever member 17 and a second lever member 18. The levers 17 and 18 are secured to the slideable member 16 at a pivot or juncture point 19.

As shown in FIG. 2, each lever as 17 and 18 has a stepped end so that the levers 17 and 18 can be positioned and pivotally mounted as shown by means of a rivet or screw assembly 19 to permit the pivoting of each lever 17 and 18 separately with respect to member 16 and to further permit the pivoting of both levers 17 and 18 in a unitary manner when using the aid.

FIGS. 3 and 4 show one mode of coupling and mounting the levers 17 and 18 to the member 16.

In FIG. 3, the slideable member may comprise a top member 16A and a bottom member 16B. Each member has an associated channel as 20A and 20B. The sections 16A and 16B can be glued or otherwise fastened together. The stepped ends of the lever members 17 and 18 are located within the channel thus formed and are pivotally mounted as shown by means of a screw, rivet as 19.

While the above description shows one structure for pivotably coupling the levers 17 and 18 to member 16, many other mechanisms can be used as well. It is a desired operating function that is to be acheived between these components to afford utility of use of the aid as will be described.

Referring again to FIG. 1, it is seen that the slideable member 16 can move from left to right within channel 14 as indicated by arrow 37. The lever 17 can pivot separately about the juncture point 19 as can lever 18. Both levers 17 and 18 can be pivoted as an integral unit about juncture 19 as well due to the pressure exerted at juncture or pivot 19.

USE AND OPERATION OF THE BOWLING AID

The principle of operation resides in the fact that a bowling ball relatively independent of the type of trajectory, is thrown by a given bowler with the same trajectory as indicated above. Thus, a straight ball thrower, or a hook or a back-up ball bowler throws the same or a similar trajectory on a given bowling lane. His trajectory for other lanes may vary, but all such variations are accommodated this device.

There are various indicia located on the surface of the top transparent planar member 10. At the upper top is a series of dots 25 representing a typical ten bowling pin formation. Above the slideable member 16 are a series of dots 26 representing the alley markers which conventionally are emplaced on an alley usually ten to sixteen feet from the foul line. A third series of dots 27 represent the bowler's starting position and are also accommodated and emplaced on a conventional bowling alley.

As is known, a bowler desires to acheive a "strike" on his first ball. The normal desire is to then direct his first ball into the pocket; which basically is on either side of the head pin. When using the aid depicted, the bowler must attempt to select his desired starting position and note the same as between or on any of the dots 27. As can be seen, both the levers 17 and 18 have guide lines as 21 and 22 for lever 18. The bowler then sets the guide 18 based on his selected starting position and based on the fact that his first ball is accompanied by a straight line approach to the foul line. Hence, as originally set, the guide lines 21 and 22 will be relatively perpendicular to the slideable member 16. When he releases the ball, the ball will cross over the alley markers 26 and this is also noted by the bowler as well as the pin or pins his ball first hits. He then holds lever 17 fixed and sets lever 18 between his starting markers as he selected and over the alley markers 26 that the ball transversed.

As indicated, the pins hit are noted and holding lever 18 fixed, he then sets lever 17 so that the guides 28 and 29 are aligned between the pin or pins the ball first contacted.

He can, with this setting, now slide member 16 so that his next first ball will be in the pocket if the first ball was not. This can be accomplished by sliding the member 16 so that the guide lines 28 and 29 access the pocket. By doing so, the aid may depict a new starting position 27 for the bowler and a new alley marker 26 indicator for his first ball. If the first ball is a good one, the original setting remains and is followed thereafter.

Assume the bowler hits the pocket, but leaves one pin standing, which for example, may be the "ten" pin designated as 30. To access this pin 30, he may slide member 16 to the left and then rotate both members 17 and 18 by accessing either one.

This is shown in dashed lines. The guide lines 21 and 22 further indicate the starting point 27 and the marker 26 that the ball is to traverse. The guide markers 21 and 22 also inform the bowler on how he is to approach the foul line (at the angle shown and how he is to stand initially at the angle shown).

The same or similar procedures can be accommodated for any spare that the bowler may be left with. Certain spares may be accommodated by merely sliding member 16; while others are accommodated by the rotation or pivoting of both levers, as an integral unit after they are preset.

It is also noted that the initial settings of levers 17 and 18 can be adjusted continuously, if desired, for different alleys or for a different ball trajectory.

Other embodiments and modifications will become apparent to those skilled in the art by reading the application as well as other ways of implementing or fabricating the structure; without departing from the spirit and scope of the invention as depicted herein.

I claim:

1. A bowling aid, comprising:

a. first and second planar members, each member having a lateral channel on a surface thereof, wherein one of said surfaces of said first or second planar members includes first indicia thereon indicative of the formation of ten bowling pins, and a second series of indicia indicative of alley markers, and a third set of indicia indicative of conventional starting markers used by a bowler to commence his approach towards the bowling pins, b. means for positioning said members one above the other with said channels positioned in congruency and facing each other to form a lateral central channel, c. a slideable member positioned within said central channel and adapted to slide laterally therein, d. first and second lever members pivotally secured to said slideable member and extending relatively transverse thereto with the ends of each of said levers furtherest removed from said pivot point extending from opposite ends of said planar members, said lever members as coupled, enabling separate pivoting of one with respect to the other in one mode, and in a second mode, a common pivoting of both said first and second levers, whereby said first lever can be separately pivoted to access said first indicia and said second indicia, and said second lever pivoted to access said third indicia in said first mode, and in said second mode, said levers pivoted integrally and when moved by said slideable member, capable of informing a bowler of any desired starting position in relation to any desired pin location which may be a target for said bowler.

2. The aid according to claim 1 wherein each of said levers has impressed thereon, a pair of parallel guide lines to depict a path from said starting markers to said first indicia indicative of pin formation.

3. The aid according to claim 1 wherein at least one of said first and second planar members is fabricated from a transparent material.

4. The aid according to claim 1 wherein said second indicia on said surface are located above said lateral channel.

5. The aid according to claim 1 wherein said first and second lever members are planar members of a generally rectangular configuration and having stepped ends at said junction point to provide a uniform thickness at said junction point when said stepped ends are in contact.

6. The aid according to claim 5 wherein said slideable member comprises a first U shaped top member and a second U shaped bottom member, said first and second members secured together at the arms of said U to form a central opening in which said stepped ends of said first and second lever members are pivotally located.

7. The aid according to claim 5 wherein said first and second lever members are fabricated from a transparent material.

8. The aid according to claim 1 wherein said means for positioning said planar members includes a plurality of stand-offs located between said first and second members.

* * * * *